US005704769A

United States Patent [19]

Michiyuki et al.

[11] Patent Number: 5,704,769

[45] Date of Patent: Jan. 6, 1998

[54] NOISE SUPPRESSING MECHANISM IN PISTON-TYPE COMPRESSOR

[75] Inventors: Hiromi Michiyuki, Anjo; Hayato Ikeda, Kariya; Hisato Kawamura, Kariya; Masanobu Yokoi, Kariya, all of Japan

[73] Assignee: Kabushiki Kaisha Toyoda Jidoshokki Seisakusho, Kariya, Japan

[21] Appl. No.: 615,632

[22] Filed: Mar. 13, 1996

[30] Foreign Application Priority Data

Mar. 20, 1995 [JP] Japan ..... 7-061244

[51] Int. Cl.[6] ..... F04B 27/08; F04D 13/02

[52] U.S. Cl. ..... 417/269; 417/365

[58] Field of Search ..... 417/269, 272, 417/365

[56] References Cited

U.S. PATENT DOCUMENTS 4,763,563 8/1988 Ikeda et al. ..... 417/269 X
4,950,132 8/1990 Brian et al. ..... 417/269
4,990,064 2/1991 Ikeda et al. ..... 417/269
5,528,976 6/1996 Ikeda et al. ..... 417/269 X
5,536,149 7/1996 Fuji et al. ..... 417/269

FOREIGN PATENT DOCUMENTS 1113164 7/1989 Japan .

*Primary Examiner*—Richard E. Gluck
*Attorney, Agent, or Firm*—Brooks Haidt Haffner & Delahunty

[57] ABSTRACT

A compressor includes a housing body and a drive shaft rotatably supported in the housing body. A drive plate is mounted on the drive shaft. Cylinder bores are defined in the housing body. Pistons are operably coupled to the drive plate and are disposed in the cylinder bores. The drive plate converts rotation of the drive shaft to reciprocating movement of the pistons in the cylinder bores. Each piston compresses gas supplied from a suction chamber to the associated cylinder bore and discharges the compressed gas to a discharge chamber. Force to minimize displacement of the drive shaft in the axial direction thereof adjusts in accordance with at least one of pressure in the discharge chamber and a rotation speed of the drive shaft.

18 Claims, 8 Drawing Sheets

NOISE SUPPRESSING MECHANISM IN PISTON-TYPE COMPRESSOR

BACKGROUND OF THE INVENTION

1. Field of the Invention

The present invention generally relates to a reciprocating piston-type swash plate compressor, and more particularly, to one that is capable of reducing operating noise.

2. Description of the Related Art

Reciprocating piston-type compressors are often used in vehicle air conditioners. FIG. 9 illustrates this kind of compressor. In this compressor, a front housing 55 is secured to the front end face of a front cylinder block 51 through a valve plate 53. A rear housing 56 is secured to the rear end face of a rear cylinder block 52 through a valve plate 54. The cylinder blocks 51 and 52, the valve plates 53 and 54, and the housings 55 and 56 are held together by a plurality of bolts 57.

A drive shaft 58 is rotatably supported in center bores 51*b* and 52*b* formed in both the cylinder blocks 51 and 52 through a pair of radial bearings 69. A swash plate 59 is fixed to the drive shaft 58 and is located within a crank chamber 60 formed between the cylinder blocks 51 and 52. A front thrust bearing 70 is located in the crank chamber 60 between the inner wall surface of the front cylinder block 51 and the front end face of the boss portion 59*a* of the swash plate 59. A rear thrust bearing 70 is located in the crank chamber 60 between the inner wall surface of the rear cylinder block 52 and the rear end face of the boss portion 59*a*. Each thrust bearing 70 is slightly elastically deformed. A plurality of aligned pairs of cylinder bores 51*a* and 52*a* are formed in the cylinder blocks 51 and 52 around the drive shaft 58. A double-headed piston 61 is retained within the corresponding pair of cylinder bores 51*a* and 52*a* and is connected to the swash plate 59 through shoes 62.

As the drive shaft 58 is rotated, the rotation of the swash plate 59 is transmitted to each piston 61 through the shoes 62, and consequently, each piston 61 is reciprocated in the cylinder bores 51*a* and 52*a*. With the reciprocating motion of the piston 61, the refrigerant gas in suction chambers 63 and 64 opens flap suction valves 72 and 73 and is drawn into the cylinder bores 51*a* and 52*a*. The refrigerant gas compressed in the cylinder bores 51*a* and 52*a* opens flap discharge valves 74 and 75 and is discharged to discharge chambers 65 and 66.

Suction passages 67 and 68 are formed in the cylinder blocks 51 and 52 around the bolt 57. Suction chambers 63 and 64 are connected with the crank chamber 60 through the suction passages 67 and 68.

In the compressor of FIG. 9, as the piston 61 compresses the refrigerant gas, the compression reaction force acts on the piston 61. The compression reaction force is transmitted to the drive shaft 58 through the piston 61 and the swash plate 59. However, the direction of the compression reaction force acting on the piston 61 varies alternately, as the traveling direction of the piston 61 varies alternately. For this reason, during the operation of the compressor, the drive shaft 58 is displaced in the axial direction with respect to stationary members such as the cylinder blocks 51 and 52 and the housings 55 and 56. As a consequence, the drive shaft 58 vibrates, and because of the vibration, the entire compressor produces noise.

Also, in the prior art compressor, the pressure in the discharge chambers 65 and 66 is greatly influenced by the heat exchange capacity of a condenser provided in an external refrigerant circuit (not shown). The heat exchange capacity of the condenser is determined by the traveling speed of the vehicle and the air temperature around the condenser. For example, during the summer period, when a vehicle is traveling at a low speed due to a traffic jam, the heat exchange capacity of the condenser is extremely low, and the pressure in the discharge chambers 65 and 66 becomes relatively high. When the external air temperature is relatively low and the vehicle is traveling at a high speed, the heat exchange capacity of the condenser is increased, and the pressure in the discharge chambers 65 and 66 becomes relatively low.

When the refrigerant gas in the cylinder bores 51*a* and 52*a* is compressed by the reciprocating motion of the piston 61, the compressed refrigerant gas in the cylinder bores 51*a* and 52*a* will open the flap discharge valves 74 and 75 and will be discharged to the discharge chambers 65 and 66 if the pressure in the bores 51*a* and 52*a* slightly exceeds the pressure in the discharge chambers 65 and 66. In other words, the flap discharge valves 74 and 75 open in accordance with the pressure difference between the cylinder bore 51*a* and the discharge chamber 65 and between the cylinder bore 52*a* and the discharge chamber 66. Therefore, when the pressure in the discharge chambers 65 and 66 is high, the refrigerant gas in the cylinder bores 51*a* and 52*a* is compressed until it reaches very high pressure. The operation of the compressor in such a state will be hereinafter referred to as "high-compression operation." At the time of this high-compression operation, the compression reaction acting on the piston 61 also becomes higher. Therefore, the displacement quantity of the drive shaft 58 in the axial direction increases, and the vibration and the noise are further increased.

In addition, the drive shaft 58 is connected directly to the engine of the vehicle, and therefore the rotation speed of the drive shaft 58 varies with the engine speed. For this reason, if the drive shaft 58 rotates at a high speed with a rise in the engine speed, the traveling speed of the piston 61 will also increase, and therefore the direction of the compression reaction force acting on the piston 61 will vary frequently. Moreover, as the piston 61 is reciprocated, an inertial force acts on the piston 61. The inertial force increases as the traveling speed of the piston 61 increases. Therefore, if the compressor is operated at a higher speed, the cycle of the displacement of the drive shaft 58 in the axial direction will become faster. Thus, the displacement quantity increases, and the vibration and the noise are increased.

Furthermore, in the prior art compressor, the pair of thrust bearings 70 are slightly elastically deformed. That is, the thrust bearings 70 have been given a preload directed in the axial direction of the drive shaft 58. During normal operation of the compressor, the displacement of the drive shaft 58 in the axial direction is suppressed with this preload and the vibration of the shaft 58 is suppressed. In order to suppress the vibration at the time of high-compression operation or high-speed operation of the compressor, the preload given to the thrust bearings 70 can be increased. However, if the preload is increased, then not only will the power required for rotating the drive shaft 58 be increased, but the thrust bearings 70 will wear. Therefore, there is a limit to increasing the preload.

Also, in the prior art compressor, a recess 71 is formed in the center of the rear housing 56. This recess 71 is connected with the crank chamber 60 through a center bore 52*b* of the rear cylinder block 52. Therefore, the pressure in the crank chamber 60 or the pressure in the suction chambers 63 and 64 is communicated with the recess 71.

Many conventional compressors have a structure where the rear end portion of the drive shaft 58 is inserted into the recess 71. In this type, or in the type of FIG. 9, the space of the recess 71 is not utilized effectively. Because of the existence of the recess 71, it is difficult to increase the volume of the discharge chamber 66. If the volume of the discharge chamber 66 is small, the pulsation resulting from the discharge of the compressed refrigerant gas and the noise resulting from the pulsation cannot be suppressed.

Japanese Unexamined Utility Model Publication No. HEI 1-113164 discloses another compressor. In this compressor, the discharge chamber is formed in the center of the rear housing. A rigid valve plate is located between the rear cylinder block and the rear housing. With this valve plate, the discharge chamber is separated from the rear cylinder block. In order to suppress the displacement of the drive shaft in the axial direction, the high pressure of the refrigerant gas in the discharge chamber must be utilized. However, in the compressor of this publication, the rigid valve plate is an obstacle to the utilization of the pressure in the discharge chamber.

SUMMARY OF THE INVENTION

It is an objective of the invention is to provide a reciprocating piston-type compressor that is capable of suppressing vibration and the resulting noise.

It is another objective of the invention to provide a reciprocating piston-type compressor that is capable of suppressing the pulsation resulting from the discharge of gas and the resulting noise.

To achieve the above objects, the compressor according to the present invention includes a housing body and a drive shaft rotatably supported in the housing body. A drive plate is mounted on the drive shaft. Cylinder bores are defined in the housing body. Pistons are operably coupled to the drive plate and are disposed in the cylinder bores. The drive plate converts the rotation of the drive shaft to a reciprocating movement of the pistons in the cylinder bores. Each piston compresses gas supplied from a suction chamber to the associated cylinder bore and discharges the compressed gas to a discharge chamber. Force to minimize the displacement of the drive shaft in axial directions thereof adjusts in accordance with at least one of the pressure in the discharge chamber and the rotational speed of the drive shaft.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment of a swash plate-type compressor of the double-headed piston type embodying the present invention will be described below with reference to FIGS. 1 to 5.

Figure 1:
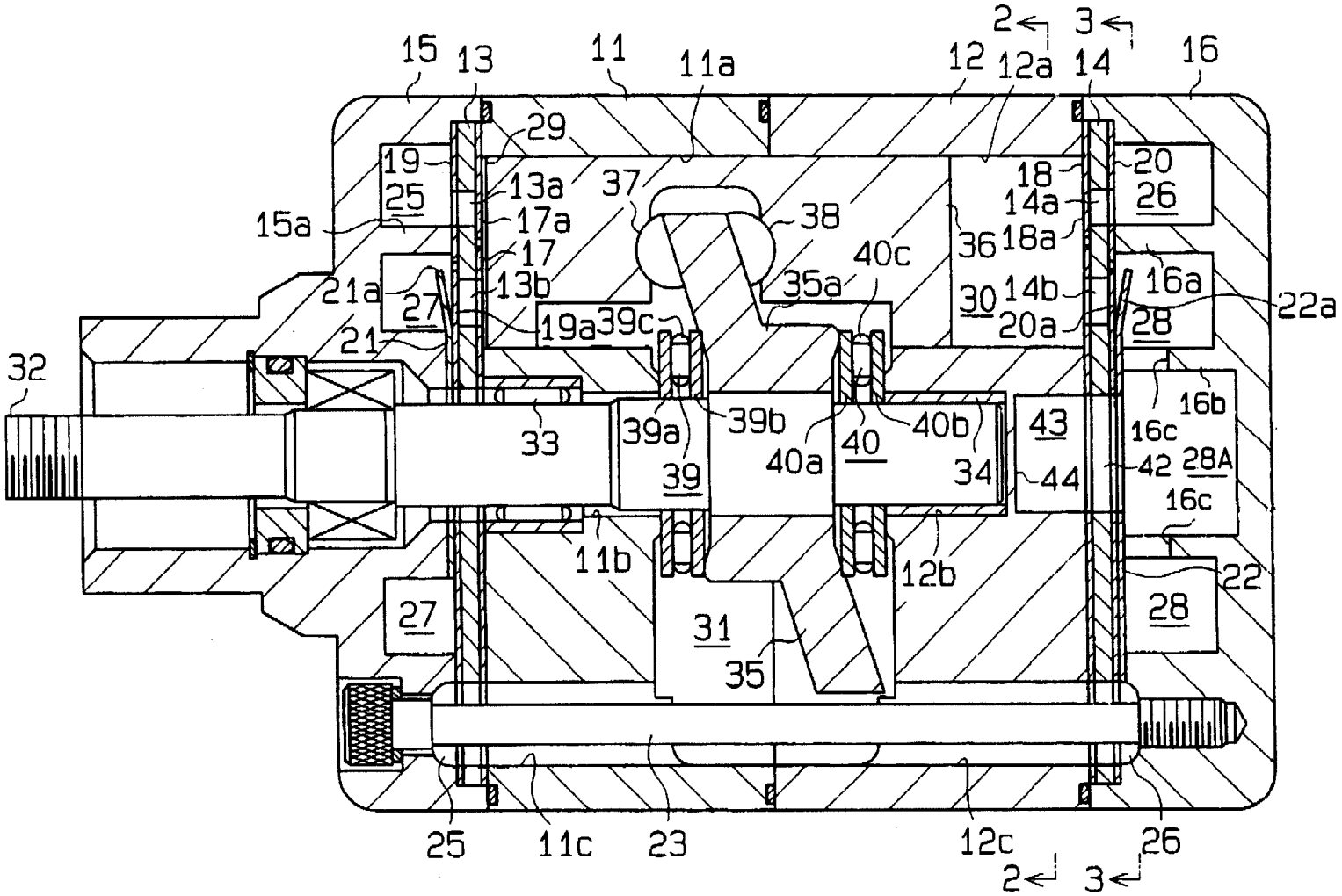
FIG. 1 is a longitudinal cross-sectional view of an overall compressor according to a first embodiment of the present invention.

As shown in FIG. 1, a front cylinder block 11 and a rear cylinder block 12 are secured to each other in face-to-face relationship. A front housing 15 is secured to the front end face of the front cylinder block 11 through a valve plate 13. A rear housing 16 is secured to the rear end face of the rear cylinder block 12 through a valve plate 14. First plates 17 and 18, forming flap suction valves 17*a* and 18*a*, are located between the cylinder block 11 and the valve plate 13 and between the cylinder block 12 and the valve plate 14, respectively. Second plates 19 and 20, forming flap discharge valves 19*a* and 20*a*, are located between the valve plate 13 and the front housing 15 and between the valve plate 14 and the rear housing 16, respectively. Third plates 21 and 22, forming retainers 21*a* and 22*a*, are located between the second plate 19 and the front housing 15 and between the second plate 20 and the rear housing 16, respectively. The retainer 21*a* regulates the degree of opening of the discharge valve 19*a*. Likewise, the retainer 22*a* regulates the degree of opening of the discharge valve 20*a*.

Figure 2:
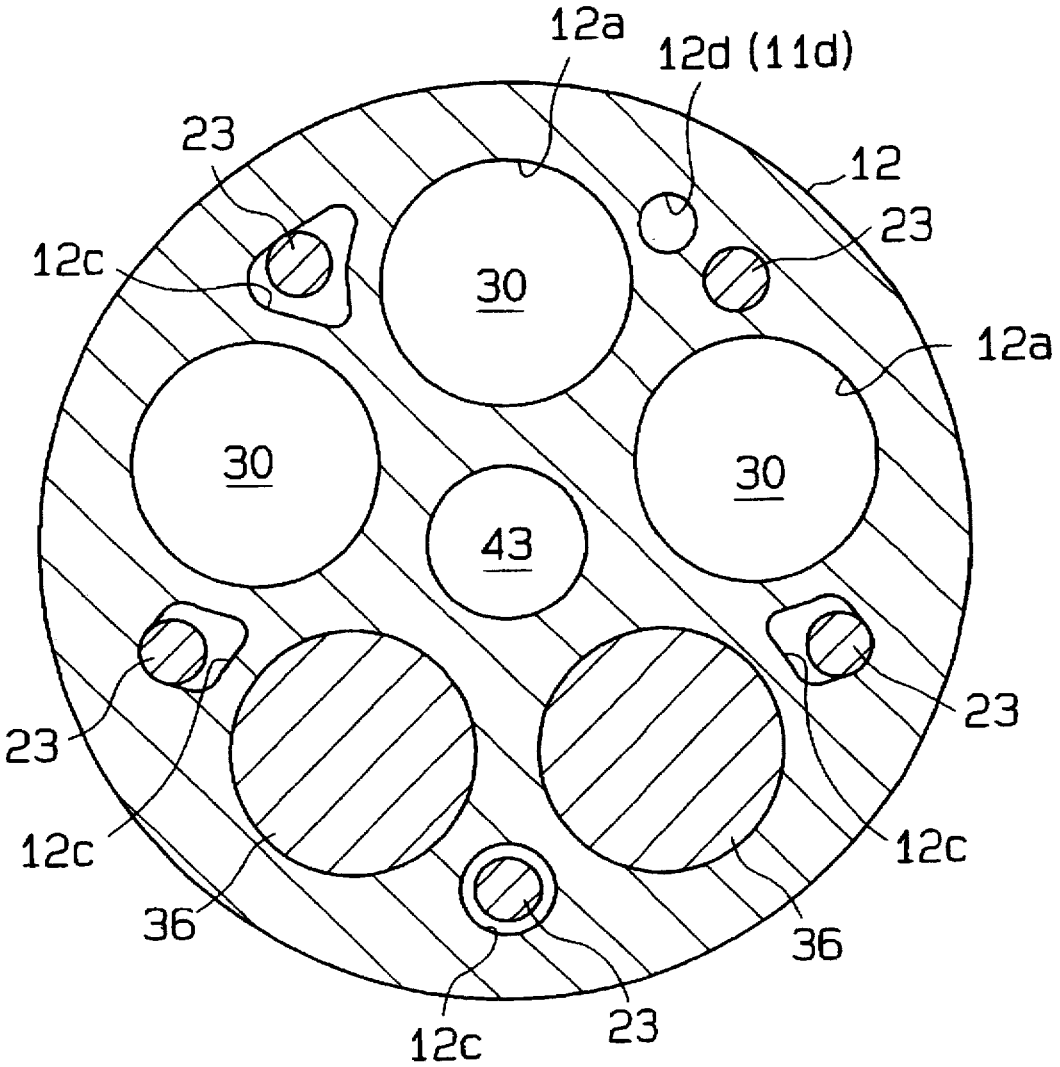
FIG. 2 is a cross-sectional view taken substantially along the line 2—2 in FIG. 1.
Figure 3:
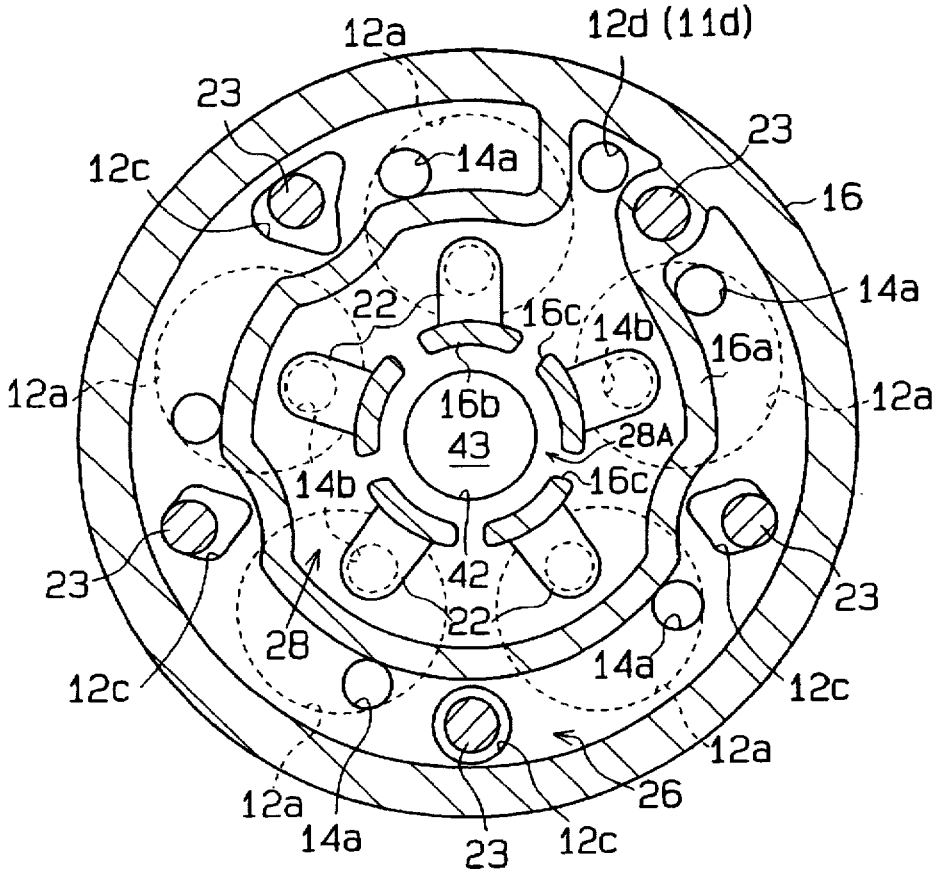
FIG. 3 is a cross-sectional view taken substantially along the line 3—3 in FIG. 1.

As shown in FIGS. 1 to 3, a plurality of bolts 23 (five bolts in this embodiment) are screwed from the front surface of the front housing 15 into the internally threaded respective bores of the rear housing 16 so that the cylinder blocks 11 and 12, the valve plates 13 and 14, the housings 15 and 16, the first plates 17 and 18, the second plates 19 and 20, and the third plates 21 and 22 are integrally clamped and fixed. The cylinder blocks 11 and 12, and the housings 15 and 16 constitute a housing body.

A drive shaft 32 is rotatably supported in center bores 11*b* and 12*b* of both the cylinder blocks 11 and 12 through a radial needle bearing 33 and a sleeve bearing 34. A plurality of aligned pairs of cylinder bores 11*a* and 12*a* are formed in the cylinder blocks 11 and 12 around the drive shaft 32. A double-headed piston 36 is housed in each corresponding pair of cylinder bores 11*a* and 12*a*. Compression chambers 29 and 30 are formed in the cylinder bores 11*a* and 12*a* by the piston 36.

A crank chamber 31 is formed in the cylinder blocks 11 and 12 between the front and rear cylinder bores 11*a* and 12*a*. A swash plate 35 is fixed as a drive plate to the drive shaft 32 in the crank chamber 31 and is connected to the intermediate portion of each piston 36 through a pair of hemispherical shoes 37 and 38. As the drive shaft 32 is rotated, the rotation of the swash plate 35 is transmitted to each piston 36 through the shoes 37 and 38, and consequently, each piston 36 is reciprocated in the cylinder bores 11*a* and 12*a*. A front thrust bearing 39 is located, in the crank chamber 31, between the inner wall surface of the front cylinder block 11 and a front end face of the boss portion 35*a* of the swash plate 35. A rear thrust bearing 40 is located, in the crank chamber 31, between the inner wall surface of the rear cylinder block 12 and a rear end face of the boss portion 35*a*.

Figure 5:
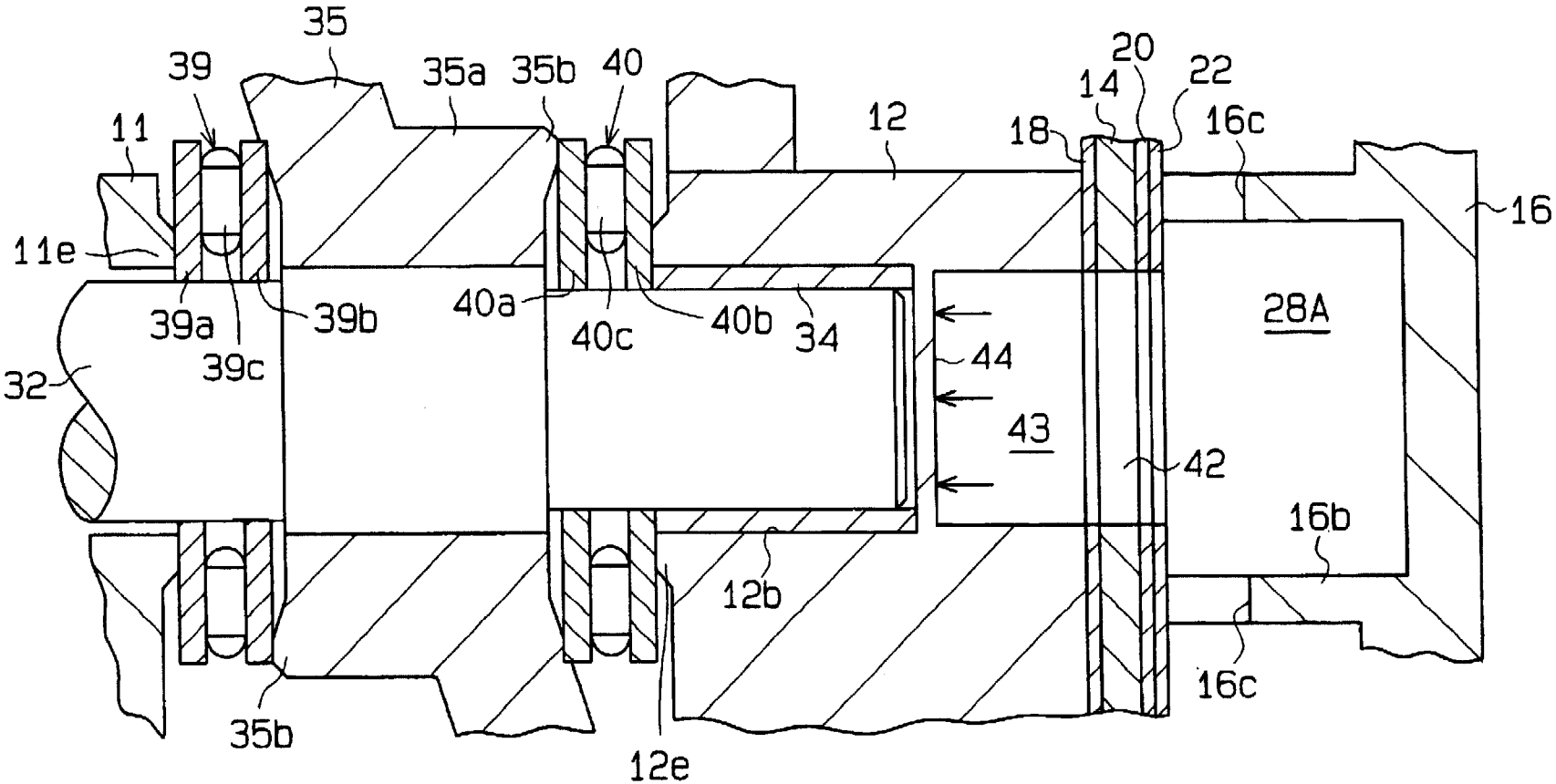
FIG. 5 is an enlarged and fragmentary longitudinal cross-sectional view showing essential parts of the compressor.

As shown in FIG. 5, the front thrust bearing 39 is constituted by a front race 39*a*, a rear race 39*b*, and a plurality of needles 39*c*. The needles 39*c* are retained between the front and rear races 39*a* and 39*b* by a retainer (not shown). Likewise, the rear thrust bearing 40 is constituted by a front race 40*a*, a rear race 40*b*, and a plurality of needles 40*c*. The needles 40*c* are retained between the front and rear races 40*a* and 40*b* by a retainer (not shown). Annular projections 11*e* and 12*e* are formed on the inner wall surfaces of the cylinder blocks 11 and 12, respectively. Annular projections 35*b* are formed on the front end face and rear end face of the boss portion 35*a* of the swash plate 35, respectively. The annular projection 11*e* of the front cylinder block 11 makes contact with the radially inner side of the front surface of the front race 39*a* of the front thrust bearing 39, while the annular projection 35*b* of the front end face of the boss portion 35*a* makes contact with the radially outer side of the rear surface of the rear race 39*b* of the front thrust bearing 39. The annular projection 12*e* of the rear cylinder block 12 makes contact with the radially inner side of the rear surface of the rear race 40*b* of the rear thrust bearing 40, while the annular projection 35*b* of the rear end face of the boss portion 35*a* makes contact with the radially outer side of the front surface of the front race 40*a* of the rear thrust bearing 40. Thus, the front thrust bearing 39 is located between the annular projection 11*e* of the front cylinder block 11 and the front annular projection 35*b* of the boss portion 35*a*, and is slightly elastically deformed, and likewise, the rear thrust bearing 40 is located between the annular projection 12*e* of the rear cylinder block 12 and the rear annular projection 35*b* of the boss portion 35*a*, and is slightly elastically deformed. Thus, the thrust bearings 39 and 40 are both given a preload directed in the axial direction of the drive shaft 32. When assembling the compressor, the dimensional tolerances of the cylinder blocks 11 and 12 and the drive shaft 32 are absorbed by the preload, and drive shaft play in the axial direction is prevented. The elastic deformation of each of the thrust bearings 39 and 40 is set to a necessary but minimum amount.

As shown in FIG. 1 and FIG. 3, discharge chambers 27 and 28 are formed in the center portions of the front and rear housings 15 and 16, respectively. Suction chambers 25 and 26 are formed in the front and rear housings 15 and 16 around the discharge chambers 27 and 28. A partition wall 15*a* is formed in the front housing 15 so that the discharge chamber 27 and the suction chamber 25 are separated from each other, and likewise, a partition wall 16*a* is formed in the rear housing 16 so that the discharge chamber 28 and the suction chamber 26 are separated from each other.

A suction port 13*a* is formed in the valve plate 13 so that the suction chamber 25 and the compression chamber 29 are connected with each other. A suction port 14*a* is formed in the valve plate 14 so that the suction chamber 26 and the compression chamber 30 are connected with each other. Likewise, discharge ports 13*b* and 14*b* are formed in the valve plates 13 and 14 so that the discharge chamber 27 and the compression chamber 29 are connected with each other and such that the discharge chamber 28 and the compression chamber 30 are connected with each other.

During the suction stroke, when the piston 36 moves from top dead center to bottom dead center, the refrigerant gas in the suction chambers 25 and 26 alternately opens the suction valves 17*a* and 18*a* and is drawn from the suction ports 13*a* and 14*a* into the compression chambers 29 and 30. During the compression and discharge strokes, when the piston 36 moves from bottom dead center to top dead center, the refrigerant gas, compressed in the compression chambers 29 and 30, alternately opens the discharge valves 19*a* and 20*a* and is discharged from the discharge ports 13*b* and 14*b* to the discharge chambers 27 and 28.

As shown in FIGS. 1 through 3, a plurality of suction passages 11*c* and 12*c* are formed around the bolts 23 and in the cylinder blocks 11 and 12 so that the crank chamber 31 and the suction chambers 25 and 26 are connected with each other, respectively. The crank chamber 31 is connected to the introduction pipe of an external refrigerant circuit (not shown). The refrigerant gas flowing through the external refrigerant circuit is introduced into the crank chamber 31 through the introduction pipe. Discharge passages 11*d* and 12*d* are formed in the cylinder blocks 11 and 12 so that they connect with discharge chambers 27 and 28, respectively. The discharge passages 11*d* and 12*d* are connected to the discharge pipe of the external refrigerant circuit. The refrigerant gas in the discharge chambers 27 and 28 is discharged to the discharge pipe through the discharge passages 11*d* and 12*d*.

As shown in FIGS. 1 through 3 and FIG. 5, an annular projection 16*b* is formed in the inner wall surface of the rear housing 16 for pressing the second and third plates 20 and 22 against the valve plate 14. A plurality of notches 16*c* are formed in the projection 16*b* so that a space 28A enclosed by the projection 16*b* communicates with the discharge chamber 28. The space 28A, therefore, forms part of the discharge chamber 28. A communication bore 42 is formed in the center of the valve plate 14, the first plate 18, the second plate 20, and the third plate 22. A recess 43 is formed in the center of the rear end face of the rear cylinder block 12 to communicate with the discharge chamber 28 through the communication bore 42 and the space 28A. The recess 43, therefore, forms part of the discharge chamber 28, together with the space 28A. The compressed refrigerant gas in the discharge chamber 28 flows into the recess 43 through the space 28A and the communication bore 42. The pressure of the refrigerant gas in the recess 43 pushes the inner end surface 44 of the recess 43 towards the front of the compressor (indicated by arrows in FIG. 5).

A description of the operation of the compressor described above follows.

If the drive shaft 32 is rotated by an external power source such as an engine of an automobile, the rotation of the drive shaft 32 will be converted to reciprocating motion of the pistons 36 in the cylinder bores 11*a* and 12*a* through the swash plate 35. As each piston 36 is reciprocated, the refrigerant gas, drawn from the introduction pipe of the external refrigerant circuit into the crank chamber 31, is introduced into the suction chambers 25 and 26 through the suction passages 11*c* and 12*c* and is then alternately drawn from the suction chambers 25 and 26 into the compression chambers 29 and 30. The refrigerant gas alternately in the compression chambers 29 and 30 is compressed by the piston 36 and then discharged to the discharge chambers 27 and 28. The high-pressure refrigerant gas in the discharge chambers 27 and 28 is discharged to the discharge pipe of the external refrigerant circuit through the discharge passages 11*d* and 12*d* and is supplied to the condenser, expansion valve, and evaporator (not shown) of the external refrigerant circuit. As a consequence, the interior of the automobile is air-conditioned.

When the compressor is operated, part of the high-pressure refrigerant gas in the discharge chamber 28 flows into the space 28A through the notches 16*c* between the annular projections 16*b* and further flows from the space 28A through the communication bore 42 into the recess 43.

The refrigerant gas pressure in the recess 43 pushes the inner end surface 44 of the recess 43 in the front direction (indicated by arrows in FIG. 5). This pushing force causes the rear cylinder block 12 to be pushed in the front direction. Consequently, the annular projection 12*e* of the rear cylinder block 12 (FIG. 5) pushes the radially inner side of the rear surface of the rear race 40*b* of the rear thrust bearing 40 in the front direction. As the inner end surface 44 is pushed in the front direction, the sleeve bearing 34 is also pushed in the front direction. As a consequence, the sleeve bearing 34 pushes the rear race 40*b* of the rear thrust bearing 40 in the front direction.

The pushing force pushing the rear race 40*b* of the rear thrust bearing 40 in the front direction is transmitted to the front race 40*a* of the rear thrust bearing 40 through the needles 40*c* and is further transmitted to the front thrust bearing 39 through the boss portion 35*a* of the swash plate 35. As a consequence, the front thrust bearing 39 is strongly clamped between the projection 11*e* of the front cylinder block 11 and the projection 35*b* of the boss portion 35*a* of the swash plate 35, and the rear thrust bearing 40 is strongly clamped between the projection 35*b* of the boss portion 35*a* and the projection 12*e* of the rear cylinder block 12. Thus, the amount of elastic deformation of each thrust bearing is increased. For this reason, the force for suppressing the displacement of the drive shaft 32 in the axial direction is increased. This force varies in accordance with the variation in the pressure in the recess 43, in other words, the variation in the pressure in the discharge chamber 28.

For example, during the summer period, when a vehicle is traveling at a low speed, the pressure in the discharge chambers 27 and 28 becomes high and the compressor is under high-compression operation. Therefore, during high-compression operation of this compressor, the pressure in the discharge chambers 27 and 28 rises, and the force for suppressing the displacement of the drive shaft 32 in the axial direction is increased. Consequently, at the time of the high-compression operation of the compressor, the displacement of the drive shaft 32 in the axial direction is suppressed, and the vibration of the compressor and the noise resulting from the vibration are thus suppressed.

Figure 4:
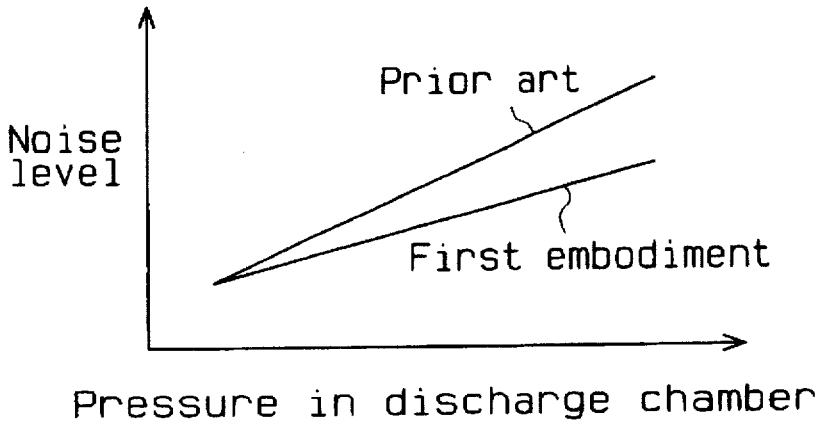
FIG. 4 is a graph showing the relationship between the pressure in the discharge chamber and the noise level.
Figure 9:
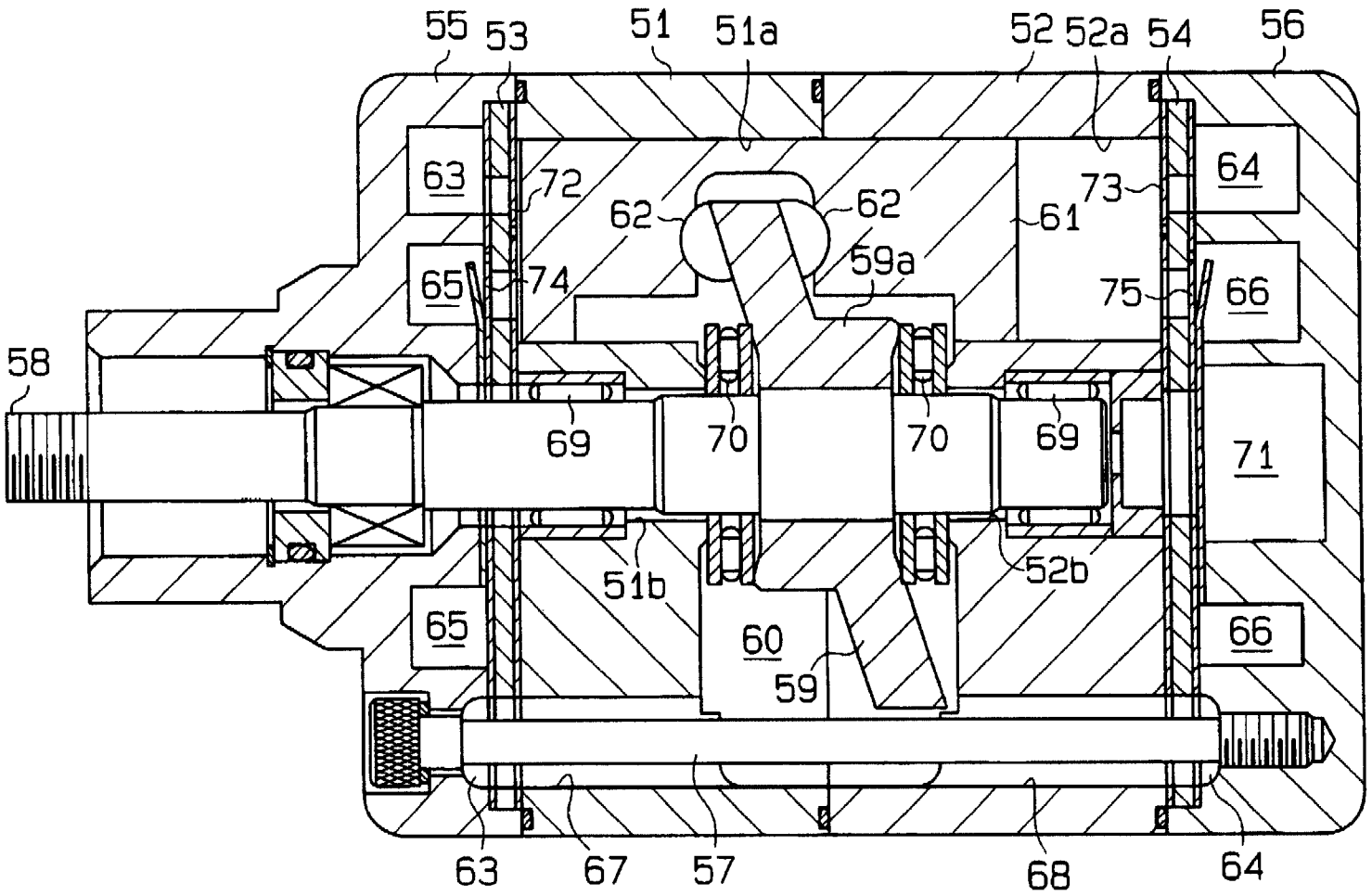
Fig.9 (Prior Art)
FIG. 9 is a longitudinal cross-sectional view showing a prior art swash plate-type compressor.

FIG. 4 is a graph showing the relationship between the pressure in the discharge chamber and the compressor noise level by comparing a conventional compressor like that of FIG. 9 with the compressor of the present invention. As evident in this graph, in the compressor of the present invention, an increase in the noise level resulting from a rise in the discharge chamber pressure in the present compressor is suppressed as compared with that in the conventional compressor.

The amount of elastic deformation of the thrust bearings 39 and 40, in other words, the force for suppressing the displacement of the drive shaft 32 in the axial direction, varies in accordance with the variations in the pressure within the discharge chambers 27 and 28. Accordingly, the force for suppressing the displacement of the drive shaft 32 can be regulated to a necessary but minimum force at all times in accordance with the operating state of the compressor. As a result, an increase in the power needed for rotating the drive shaft 32 is suppressed as much as possible. Early wear of the thrust bearings 39 and 40 is also avoided.

The compressed refrigerant gas, discharged from the compression chamber 30 to the discharge chamber 28, further flows into the space 28A and the recess 43. In other words, the space 28A and the recess 43 form part of the discharge chamber 28. For this reason, the volume of the entire discharge chamber is substantially increased. Consequently, the compressed refrigerant gas, discharged from the compression chamber 30 to the discharge chamber 28, is reduced at the discharge chamber 28 to a fixed pressure and is then supplied to the external refrigerant circuit through the discharge passage 12*d*. Therefore, pulsation resulting from the discharge of the compressed refrigerant gas and the noise resulting from the pulsation is suppressed without increasing the outer size of the compressor.

Now, a second embodiment of the present invention will be described with reference to FIG. 6. The same reference numerals will be applied to the same parts and members as those of the first embodiment, and therefore a detailed description will not be given.

Figure 6:
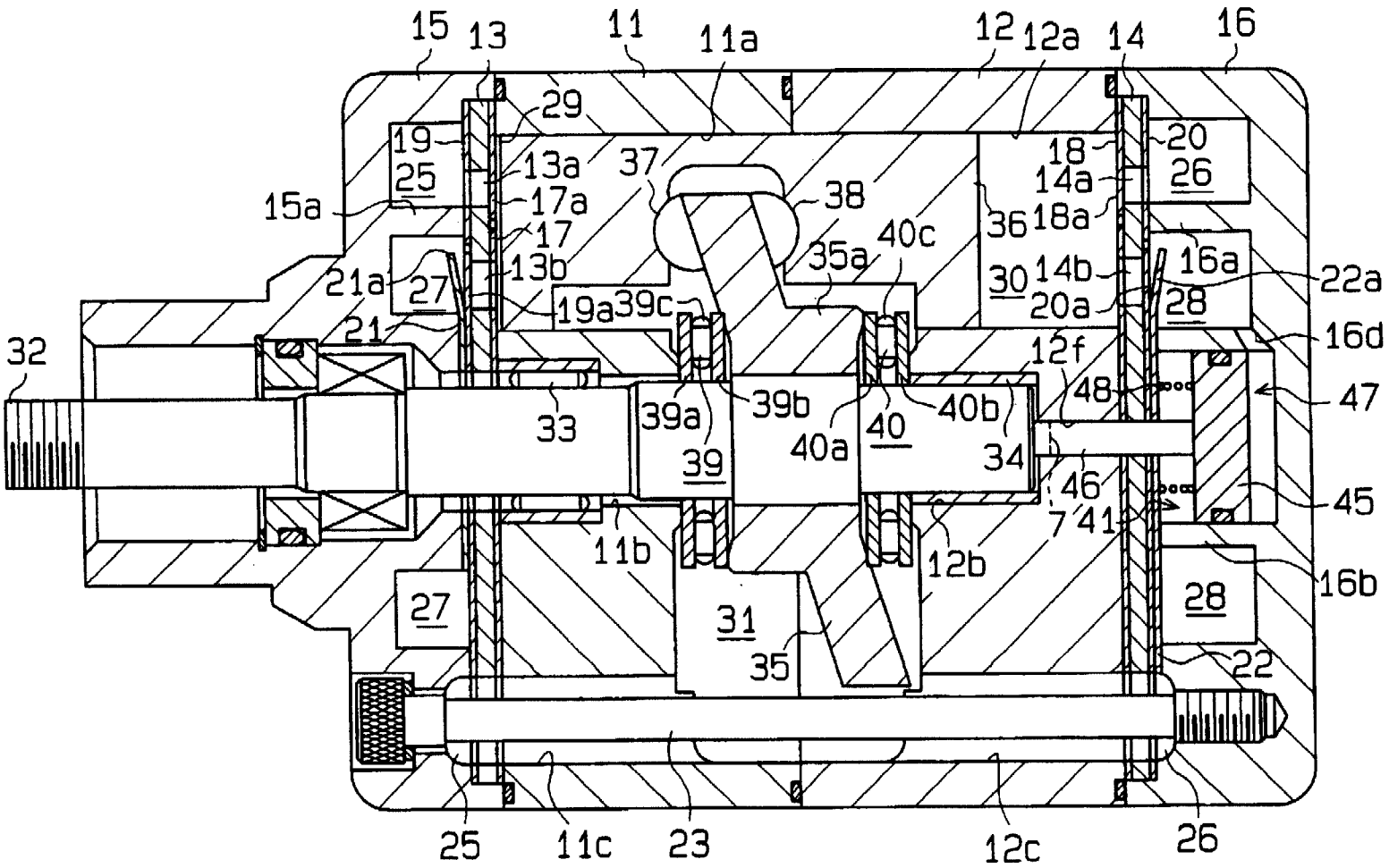
FIG. 6 is a longitudinal cross-sectional view showing a second embodiment of the compressor of the present invention.

In the second embodiment, as shown in FIG. 6, the recess 43 in the first embodiment is omitted, but a space enclosed by an annular projection 16*b* of the rear housing 16 forms a piston chamber. A piston 45 is slidably housed in the piston chamber along the axial direction of the drive shaft 32 and partitions the piston chamber into the rear chamber 47 and a front chamber 41. The piston 45 is urged towards the rear of the compressor by means of a spring 48. A rod 46 is fixed to the piston 45. The rod 46 is inserted into an insertion bore 12*f* of a cylinder block 12 so that its front end engages the rear end face of the drive shaft 32. A communication bore 16*d* is formed in the annular projection 16*b* of the rear housing 16 to communicate the rear chamber 47 with the discharge chamber 28. Therefore, the pressure in the discharge chamber 28 is communicated to the rear chamber 47. The front chamber 41 communicates with the crank chamber 31 through a slight gap between the rod 46 and the insertion bore 12*f*. Therefore, the pressure in the crank chamber 31 or the pressure in suction chambers 25 and 26 is approximately the same as that in the front chamber 41.

When the compressor is operated, part of the high-pressure refrigerant gas in the discharge chamber 28 flows into the rear chamber 47 through the communication bore 16*d*. The pressure of the refrigerant gas in the rear chamber 47 pushes the piston 45 toward the front direction against the urging force of the spring 48. With this force, the drive shaft 32 is pushed in the front direction through the rod 46 and therefore the displacement of the drive shaft 32 in the axial direction is suppressed. The force pushing the drive shaft 32 in the front direction or the force for suppressing the displacement of the drive shaft 32 in the axial direction varies in accordance with the variation in the pressure of the rear chamber 47 (in other words, pressure in the discharge chamber 28). Therefore, in the second embodiment, as in the first embodiment, the displacement of the drive shaft 32 in the axial direction is suppressed during high-compression operation, and the vibration and noise are suppressed.

Now, a third embodiment of the present invention will be described with reference to FIG. 7. The same reference numerals will be applied to the same parts and members as those of the second embodiment, and therefore a detailed description will not be given.

Figure 7:
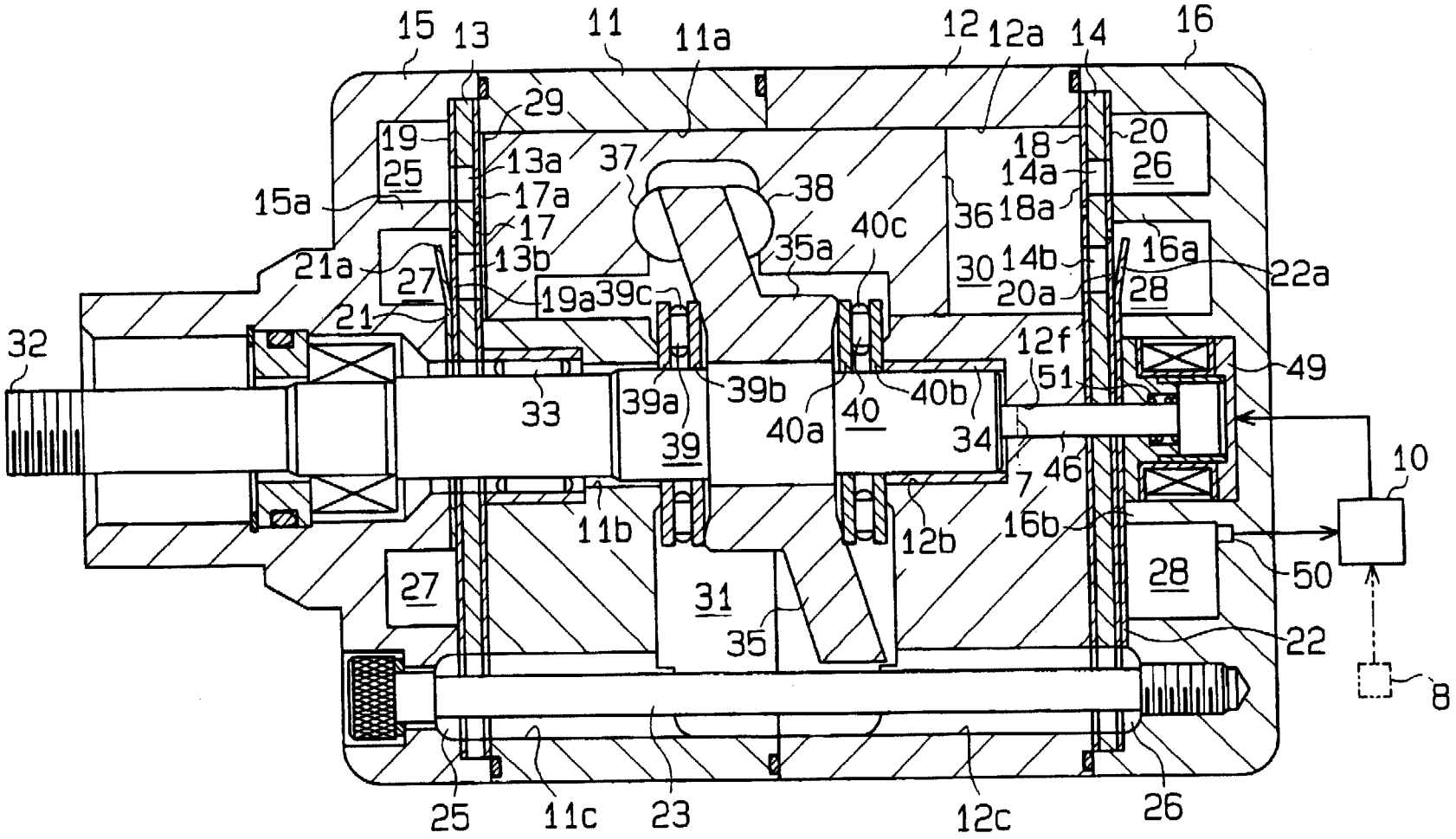
FIG. 7 is a longitudinal cross-sectional view showing a third embodiment of the compressor of the present invention.

In the third embodiment, as shown in FIG. 7, an electromagnetic solenoid 49 is housed in a position corresponding to the piston chamber of the second embodiment. The front end of a rod 46 of the solenoid 49 engages with the rear end face of the drive shaft 32. A pressure sensor 50 detects the pressure in the discharge chamber 28 and sends an output signal based on the detection to a control circuit 10. The control circuit 10, if judging that the pressure in the discharge chamber 28 is greater than a predetermined value, based on the detection signal from the pressure sensor 50, will actuate the electromagnetic solenoid 49 to urge the rod 46 in the front direction against the bias pressure of a spring 51. With this urging, the drive shaft 32 is pushed in the front direction and the displacement of the drive shaft 32 in the axial direction is suppressed.

Therefore, in the third embodiment, as in the first and second embodiments, the displacement of the drive shaft 32 in the axial direction is suppressed during high-compression operation, and the vibration and noise of the compressor are suppressed.

Now, a fourth embodiment of the present invention will be described with reference to FIG. 8. The same reference numerals will be applied to the same parts as those of the first embodiment, and therefore a detailed description will not be given.

Figure 8:
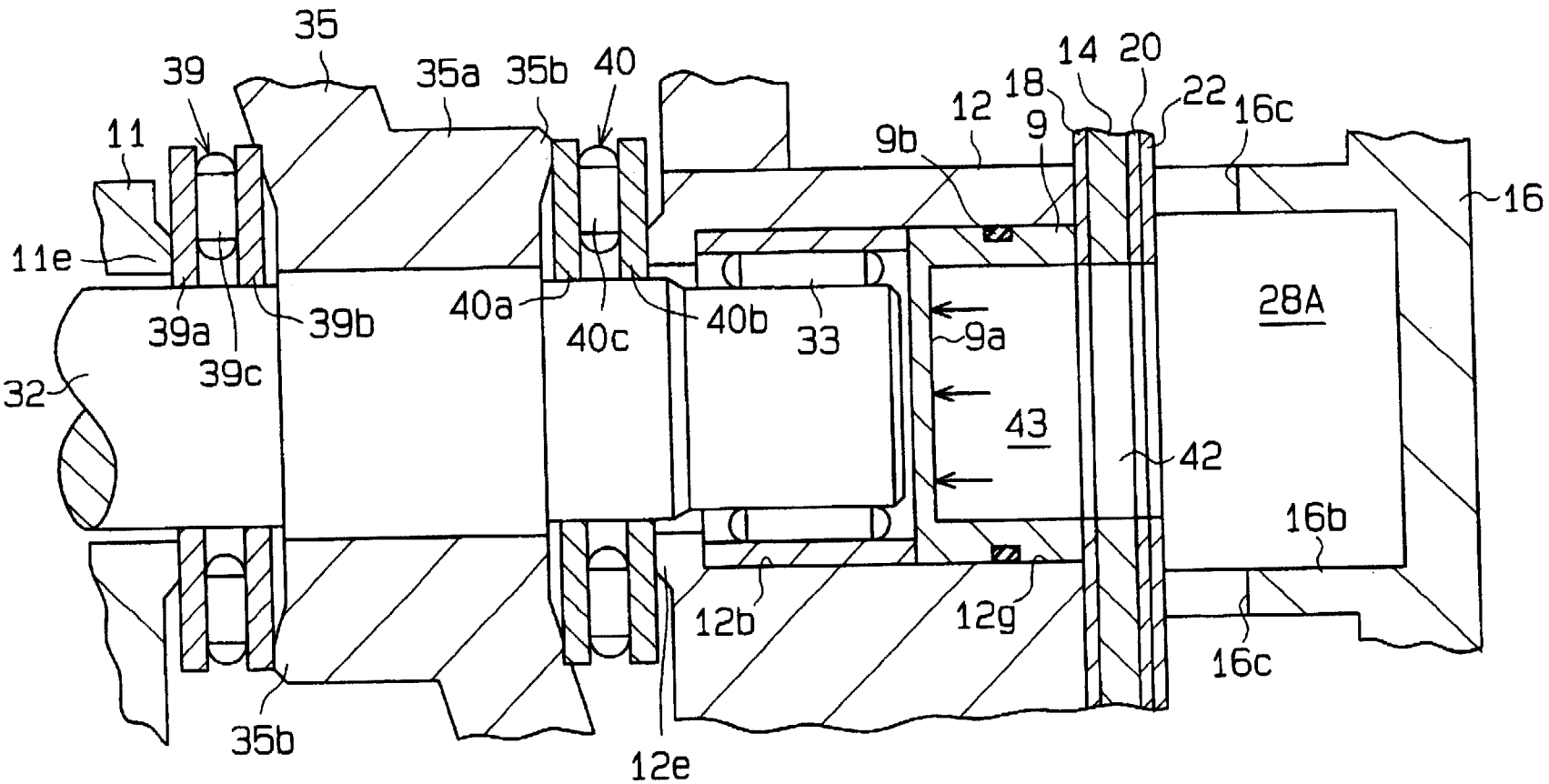
FIG. 8 is an enlarged and fragmentary longitudinal cross-sectional view showing a fourth embodiment of the compressor of the present invention.

In the fourth embodiment, as shown in FIG. 8, a housing bore **12*g* connecting with the center bore 12*b* is formed in the rear cylinder block 12. A cylindrical body 9, the front end of which is closed, is slidably housed in the housing bore 12*g* along the axial direction of the drive shaft 32. The inside 43 of this cylindrical body 9 is the equivalent of the recess 43 shown in the first embodiment and is therefore similarly numbered. A sealing ring 9*b* is mounted in the outer periphery of the cylindrical body 9 to seal between the outer peripheral surface of the cylindrical body 9 and the inner peripheral surface of the housing bore 12*g*. In addition, a radial needle bearing 33 is provided instead of the sleeve bearing 34** of the first embodiment.

When the compressor is operated, part of the high-pressure refrigerant gas in the discharge chamber 28 flows into the recess 43 from the space 28A. The pressure of the refrigerant gas in the recess 43 pushes the inner end surface **9*a* of the cylindrical body 9 towards the front as indicated by the arrows in FIG. 8. With this force, the cylindrical body 9 pushes the annular projection 12*e* of the rear cylinder block 12 in the front direction through the radial needle bearing 33. Consequently, the projection 12*e* pushes the rear race 40*b* of the thrust bearing 40 in the front direction, and the force for suppressing the displacement of the drive shaft 32** in the axial direction is increased.

Therefore, the force produced by the pressure in the recess 43 acts on the necessary portion of the cylinder block 12 or the projection **12*e* only. For this reason, the force for suppressing the displacement of the drive shaft 32** in the axial direction is effectively increased, and the vibration and noise are suppressed more reliably.

In the fourth embodiment, the sleeve bearing 34 of the first embodiment may be used instead of the radial needle bearing 33, and the bearing 34 may directly contact the race **40*b* of the thrust bearing 40**.

Note that the present invention can be also embodied as follows:

(1) In the first embodiment, the recess 43 may be provided in the front cylinder block 11. Alternatively, the recess 43 may be provided in both the cylinder blocks 11 and 12.

(2) In the second and third embodiments, as shown by a two-dot chain line in FIGS. 6 and 7, a thrust bearing 7 may be placed between the front end face of the rod 46 and the rear end face of the drive shaft 32. If constructed like this, the rotation of the drive shaft 32 will become smooth.

(3) In the second and third embodiments, the thrust bearing 40 may be pushed with the rod 46, instead of the structure where the drive shaft 32 is pushed by the rod 46.

(4) In the third embodiment, as shown by a two-dot chain line in FIG. 7, a sensor 8 is provided for sensing the rotation speed of the drive shaft 32. The control circuit 10, if judging that the rotation speed of the drive shaft 32 is greater than a predetermined value, based on the detection signal from the sensor 8, will actuate the electromagnetic solenoid 49 to urge the rod 46 toward the front. If constructed like this, the displacement of the drive shaft 32 in the axial direction will be reliably suppressed not only during high-compression operation, but also during high-speed operation, and the vibration and noise will be more reliably suppressed.

(5) The present invention can be used with any type of piston compressors such as a swash plate-type compressor of a single head piston type or a variable displacement-type compressor of the piston type where the discharge displacement can be adjusted by changing the angle of inclination of a swash plate. Particularly, in a case where the structure described in (4) is applied to a variable displacement-type compressor of the piston type, the vibration and the noise, which are produced when the drive shaft is rotated at a high speed, can be reliably suppressed even during small-capacity operation where the discharge pressure is low.

Therefore, the present examples and embodiments are to be considered as illustrative and not restrictive and the invention is not to be limited to the details given herein, but may be modified within the scope of the appended claims.

What is claimed is:

1. A compressor comprising a housing body, a drive shaft rotatably supported in the housing body, a drive plate mounted on the drive shaft, at least one cylinder bore defined in the housing body and a piston operably coupled to the drive plate and disposed in the cylinder bore, wherein said drive plate converts rotation of the drive shaft to reciprocating movement of the piston in the cylinder bore to compress gas supplied from a suction chamber to the cylinder bore and discharge the compressed gas to a discharge chamber, axial force acting on the piston due to the reciprocating movement of the piston:

the housing body having a pair of opposed inner surfaces, said drive plate being disposed between the opposed inner surfaces of the housing body and having a boss portion, said boss portion having a pair of opposite end faces each opposing a respective one of said inner surfaces of the housing body;

a pair of thrust bearings, each thrust bearing being disposed between a respective one of said end faces of the boss portion and the respective inner surface of the housing body, for applying an axial preload to the drive shaft; and means for applying a force to minimize displacement of the drive shaft in the axial direction thereof in accordance with said axial force acting on the piston.

2. The compressor as set forth in claim 1, wherein said means for applying a force includes means for biasing said pair of thrust bearings in the axial direction of the drive shaft to substantially cancel the force caused by the reciprocating movement of the piston and acting on the drive shaft, wherein said biasing means increases biasing force in accordance with an increase of the pressure in the discharge chamber.

3. The compressor as set forth in claim 2, wherein said housing body includes a cylinder block having the cylinder bore, and a housing member coupled to the cylinder block to define the discharge chamber, wherein said biasing means includes a recess formed in the cylinder block and communicating with the discharge chamber, and whereby compressed gas introduced into the recess from the discharge chamber applies the biasing force to the pair of thrust bearings by way of the cylinder block to suppress the axial movement of the drive shaft.

4. The compressor as set forth in claim 2, wherein said biasing means includes:

a pressure chamber disposed in the housing body, said pressure chamber communicating with the discharge chamber; and a holding member housed in the pressure chamber, said holding member being arranged to move along the axial directions of the drive shaft and engaging the drive shaft, wherein said holding member applies force to the drive shaft to suppress the axial movement of the drive shaft when the compressed gas is introduced into the pressure chamber from the discharge chamber.

5. The compressor as set forth in claim 4, wherein said housing body includes a cylinder block having the cylinder bore and a housing member coupled to the cylinder block to define the discharge chamber and the pressure chamber, wherein said holding member has a rod inserted in the cylinder block to engage the drive shaft.

6. The compressor as set forth in claim 5 further comprising a second thrust bearing disposed between the drive shaft and the rod.

7. The compressor as set forth in claim 2, wherein said biasing means includes:

an actuator having a member for abutting the drive shaft;

at least one sensor for respectively detecting the pressure in the discharge chamber and the rotation speed of the drive shaft, each sensor outputting a signal in accordance with the detection; and means for activating the actuator based on the signal, wherein said abutting member applies force to the drive shaft to suppress the axial movement of the drive shaft when the actuator is activated.

8. The compressor as set forth in claim 7, wherein said actuator includes an electromagnetic solenoid.

9. The compressor as set forth in claim 8 further comprising a third thrust bearing between the drive shaft and the abutting member.

10. The compressor as set forth in claim 2, wherein said housing body includes:

a cylinder block having the cylinder bore; and a housing member coupled to the cylinder block to define the discharge chamber, and wherein said biasing means includes:

said cylinder block having a bore;

a cylindrical body accommodated in the bore, said cylindrical body being arranged to move in the axial direction of the drive shaft, said cylindrical body having a closed end and an inner space communicating with the discharge chamber; and said cylindrical body being arranged to apply pre-load to the first thrust bearing to suppress the axial movement of the drive shaft when the compressed gas is introduced into the inner space from the discharge chamber.

11. The compressor as set forth in claim 2, wherein said housing body includes:

a front cylinder block and a rear cylinder block coupled to each other, at least one pair of opposing coaxial cylinder bores formed in said cylinder blocks with each of said cylinder blocks containing one of the cylinder bores of each pair of bores, wherein each pair of said opposing cylinder bores contains a piston having a front head and a rear head, with the cylinder bores in the front cylinder block containing said front heads and the cylinder bores in the rear cylinder block containing said rear heads;

a front housing coupled to a front end of the front cylinder block; and a rear housing coupled to a rear end of the rear cylinder block;

wherein each of said housings define a discharge chamber for the cylinder bores in the adjacent cylinder block.

12. A compressor comprising a housing body, a drive shaft rotatably supported in the housing body, a drive plate mounted on the drive shaft, at least one cylinder bore defined in the housing body and a piston operably coupled to the drive plate and disposed in the cylinder bore, wherein said drive plate converts rotation of the drive shaft to reciprocating movement of the piston in the cylinder bore to compress gas supplied from a suction chamber to the cylinder bore and discharge the compressed gas to a discharge chamber, axial force acting on the piston due to the reciprocating movement of the piston;

the housing body including a cylinder block containing the cylinder bore and a housing member coupled to the cylinder block to define the discharge chamber, said cylinder block having an inner surface, and said drive plate having a boss portion, said boss portion having an end face opposing said inner surface of the cylinder block;

at least one thrust bearing disposed between the end face of the boss portion and the inner surface of the cylinder block for applying an axial preload to the drive shaft; and means for applying a force to minimize displacement of the drive shaft in the axial direction thereof in accordance with said axial force acting on the piston.

13. The compressor as set forth in claim 12, wherein said means for applying a force includes means for biasing said thrust bearing in the axial direction of the drive shaft to substantially cancel the force caused by the reciprocating movement of the piston and acting on the drive shaft, wherein said biasing means increases biasing in accordance with an increase of the pressure in the discharge chamber.

14. The compressor as set forth in claim 13, wherein said biasing means includes a recess formed in the cylindrical block and communicating with the discharge chamber, and whereby compressed gas introduced into the recess from the discharge chamber applies the biasing force to the thrust bearing by way of the cylinder block to suppress the axial movement of the drive shaft.

15. The compressor as set forth in claim 13, wherein said biasing means includes:

a pressure chamber disposed in the housing member, said pressure chamber communicating with the discharge chamber; and a holding member housed in the pressure chamber, said holding member being arranged to move along the axial direction of the drive shaft, said holding member having a rod inserted in the cylinder block to engage the drive shaft, wherein said rod of the holding member applies force to the drive shaft to suppress the axial movement of the drive shaft when the compressed gas is introduced into the pressure chamber from the discharge chamber.

16. The compressor as set forth in claim 13, wherein said biasing means includes:

an electromagnetic solenoid disposed in the housing member, said solenoid having a member for abutting the drive shaft, said abutting member inserted in the cylinder block;

at least one sensor for respectively detecting the pressure in the discharge chamber and the rotation speed of the drive shaft, each sensor outputting a signal in accordance with the detection; and means for actuating the solenoid based on the signal, wherein said abutting member applies force to the drive shaft to suppress the axial movement of the drive shaft when the solenoid is actuated.

17. The compressor as set forth in claim 13, wherein said biasing means includes:

said cylinder block having a bore;

a cylindrical body accommodated in the bore, said cylindrical body being arranged to move in the axial direction of the drive shaft, said cylindrical body having a closed end and an inner space communicating with the discharge chamber; and said cylindrical body being arranged to apply pre-load to the thrust bearing to suppress the axial movement of the drive shaft when the compressed gas is introduced into the inner space from the discharge chamber.

18. A compressor for use in a vehicle, the compressor comprising a housing body, a drive shaft rotatably supported in the housing body, a drive plate mounted on the drive shaft, at least one cylinder bore defined in the housing body and a piston operably coupled to the drive plate and disposed in the cylinder bore, wherein said drive plate converts rotation of the drive shaft to reciprocating movement of the piston in the cylinder bore to compress gas supplied from a suction chamber to the cylinder bore and discharge the compressed gas to a discharge chamber, axial force acting on the piston due to the reciprocating movement of the piston, said housing body including:

a front cylinder block and a rear cylinder block coupled to each other, said front cylinder block and said rear cylinder block respectively containing one of at least one pair of opposing coaxial cylinder bores, wherein each pair of said opposing cylinder bores contains a piston having a front head and a rear head, with the cylinder bores in the front cylinder block containing said front heads and the cylinder bores in the rear cylinder block containing said rear heads;

a front housing coupled to a front end of the front cylinder block; and a rear housing coupled to a rear end of the rear cylinder block, wherein each of said housings define a discharge chamber for the cylinder bores in the adjacent cylinder block;

said front cylinder block and said rear cylinder block respectively having opposing inner surfaces;

said drive plate having a boss portion having a pair of end faces each opposing a respective one of the inner surfaces of the front cylinder block and the rear cylinder block;

said compressor further comprising a pair of thrust bearings, each thrust bearing being disposed between a respective one of said end faces of the boss portion and a respective one of the inner surface of the front cylinder block and the rear cylinder block for applying an axial preload to the drive shaft;

means for applying a force in accordance with said axial force acting on the piston; and said force applying means including means for biasing the thrust bearings in the axial direction of the drive shaft to substantially cancel the force caused by the reciprocating movement of the piston and acting on the drive shaft, wherein said biasing means increases biasing force in accordance with an increase of the pressure in the discharge chamber.

* * * * *